United States Patent [19]

Ohno

[11] Patent Number: 4,515,204

[45] Date of Patent: May 7, 1985

[54] CONTINUOUS METAL CASTING

[75] Inventor: Atsumi Ohno, Chofu, Japan

[73] Assignees: Nippon Light Metal Company Limited; O.C.C. Company Limited, both of Tokyo, Japan

[21] Appl. No.: 449,650

[22] Filed: Dec. 14, 1982

[51] Int. Cl.[3] ..... B22D 11/10; B22D 27/04

[52] U.S. Cl. ..... 164/483; 164/338.1; 164/459; 164/486; 164/488; 164/490

[58] Field of Search ..... 164/483, 484, 485, 486, 164/487, 488, 122.1, 122.2, 459, 338.1, 490

[56] References Cited

U.S. PATENT DOCUMENTS 2,135,183 11/1938 Junghans ..... 164/484
2,955,334 10/1960 Pulsifer ..... 164/484
4,222,431 9/1980 Bryson ..... 164/490

FOREIGN PATENT DOCUMENTS 913604 9/1946 France ..... 164/484
55-46265 11/1980 Japan ..... 164/484

*Primary Examiner*—Kuang Y. Lin
*Assistant Examiner*—Richard K. Seidel
*Attorney, Agent, or Firm*—William J. Daniel

[57] ABSTRACT

Molten metal is supplied into a mold having an inlet and an outlet opening in such a manner that the molten metal may have a substantially zero pressure at the outlet opening of the mold, while the inner wall of the mold is maintained at a temperature sufficiently higher than the solidifying temperature of the molten metal so that the contiguous surface of the metal remains liquid until it has left the molten outlet. A dummy bar having a temperature lower than the solidifying temperature of the molten metal is brought into contact with the molten metal at the outlet opening of the mold, and moved away from the outlet opening, whereby a solidified body of the metal is formed continuously on the end of the dummy bar.

12 Claims, 6 Drawing Figures

(a)

(b)

CONTINUOUS METAL CASTING

BACKGROUND OF THE INVENTION

1. Field of the Invention

This invention relates to a process for the continuous casting of a metal ingot having a smooth and beautiful surface.

2. Description of the Prior Art

A metal ingot obtained by continuous casting usually does not have a completely smooth surface, but presents an uneven, and often locally cracked surface. This is due to the use of a cold mold in any conventional continuous casting process. A solid skin defining the surface of an ingot is formed within the mold, and a friction develops between the skin of the ingot and the inner surface of the mold when the ingot moves through the mold. If an ingot having any such surface defect is subjected directly to working by plastic deformation, such as forging or rolling, there results a product having a number of defects. Therefore, surface scalping or scarfing of the ingot is required beforehand. If the ingot has too deep a crack, it cannot be subjected to such working, but must be remelted to form a satisfactory ingot.

According to the conventional continuous casting process employing a cold mold, the ingot usually leaves the mold through its bottom. If a solid skin formed by the metal to be cast adheres to the inner surface of the mold, the solid skin is prevented from moving toward the exit of the mold, and results in breakage. If such breakage occurs in the vicinity of the mold exit, the molten metal surrounded by the solid skin blows out through the bottom of the mold. This phenomenon is called a breakout, and not only disables the continuation of the casting operation, but also presents a serious threat to the safety of the operation. The breakout is particularly likely to occur to a metal or alloy having a wide solidification temperature range. Therefore, in order to prepare a continuous cast ingot of any such metal, for example, cast iron or phosphor bronze, there is no alternative but to rely on an intermittent process in which the molten metal is completely solidified with the mold. This process is very troublesome and time-consuming.

In order to solve this problem, the inventor of this invention has proposed a new process as disclosed in Japanese Patent Publication No. 46265/1980 published on Nov. 21, 1980. This process has, however, been still unsatisfactory in failing to provide a smooth and beautiful cast surface, though it has turned out to provide a more or less satisfactory solution to the problem of breakout. There has, therefore, been a demand for a further improvement.

SUMMARY OF THE INVENTION

This invention provides a novel process which overcomes the drawbacks of the prior art as hereinabove pointed out, and enables the continuous casting of a metal ingot having a smooth and beautiful surface with a high degree of stability in operation without involving any danger of breakout. More specifically, this invention provides a continuous metal casting process which comprises introducing molten metal into a mold provided with an inlet opening for the molten metal and an outlet opening for an ingot, and having an inner wall surface temperature exceeding the solidifying temperature of the metal to be cast, in such a manner that the surface of the molten metal at the outlet opening of the mold may have a substantially zero pressure, bringing a dummy bar having a temperature lower than the solidifying temperature of the molten metal into contact with the molten metal surface at the outlet opening of the mold, and withdrawing the dummy bar from the outlet opening of the mold, whereby a solidified metal body is formed continuously on the end of the dummy bar.

This invention enables the continuous casting, in a downward, upward, horizontal or other direction, of an ingot of a practically useful metal or alloy having a cross-sectional shape in the form of a plate, bar, tube or the like, and a smooth and beautiful surface without involving any danger of breakout.

It is, therefore, an object of this invention to provide a novel process which enables the continuous casting of a metal ingot having a smooth and beautiful surface with a high degree of ease and stability without encountering any danger of breakout.

It is another object of this invention to provide a metallic material having a cross-sectional shape in the form of a bar, plate, tube or the like, and which hardly requires any surface scalping.

It is a further object of this invention to obtain economically a metallic material having a unidirectional columnar structure.

These objects and advantages will become more apparent from the following detailed description of the basic concept and various embodiments of this invention.

DETAILED DESCRIPTION OF THE INVENTION

Figure 1:
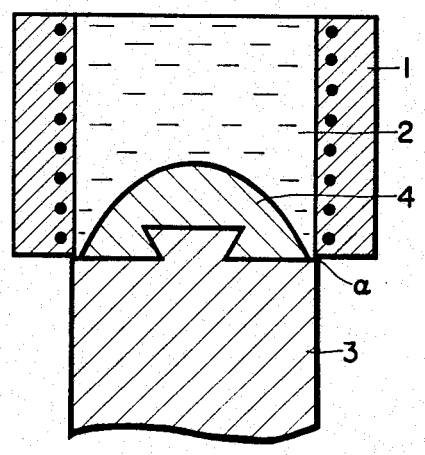
FIGS. 1(*a*) and 1(*b*) are schematic representations illustrating the basic concept of this invention.
Figure 1:
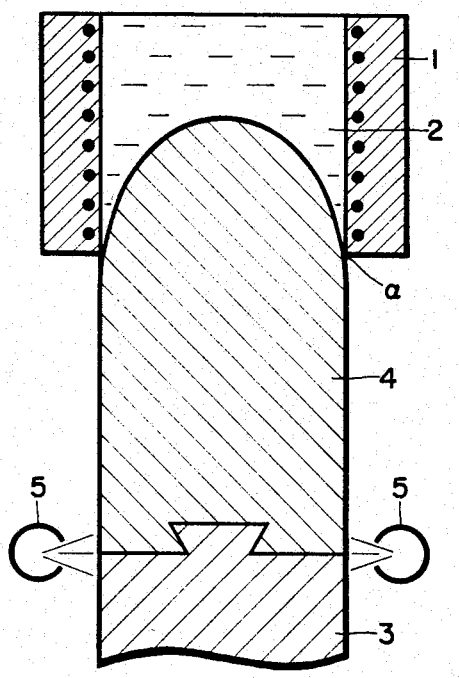

FIG. 1(*a*) illustrates the condition of the casting mold which exists immediately before continuous casting is started in accordance with this invention, and FIG. 1(*b*) shows the condition existing after the casting operation has been started. FIGS. 1(*a*) and 1(*b*) show a mold 1 arranged for downward casting provided with a heater in the wall thereof molten metal 2, a dummy ingot or bar 3 which is vertically movable by an appropriate driving unit not shown, an ingot 4 being formed by continuous casting, and a device 5 for cooling the dummy or continuously cast ingot.

The inner wall of the mold 1 is heated by the heater therein to a temperature which is higher than the solidifying temperature of the molten metal, and the molten metal 2 is introduced into the mold 1. The molten metal 2 is under zero or substantially zero pressure at the lower end $\alpha$ of the mold 1 defining an outlet opening.

Figure 5:
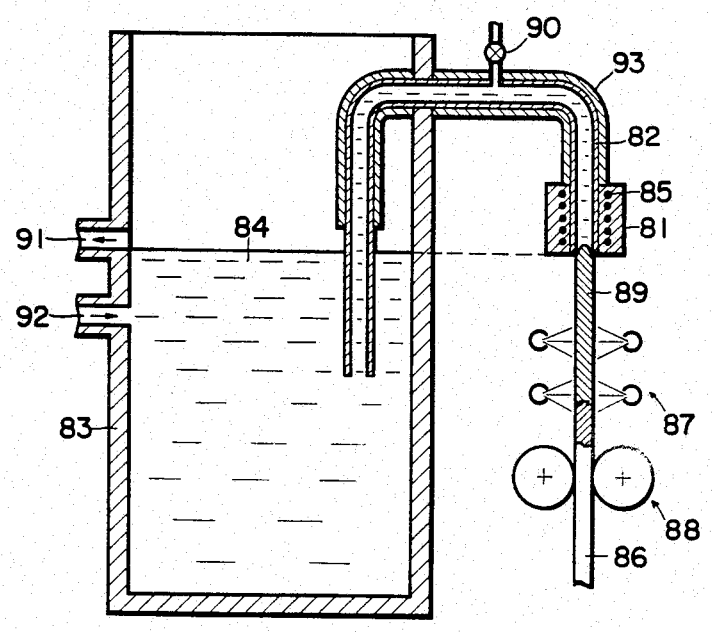
FIG. 5 is a vertical sectional view of an apparatus for carrying out the process of this invention as applied to continuous casting in a downward direction.

The molten metal may be introduced into the mold by, for example, a system as shown in FIG. 5. The system comprises a siphon pipe having one end immersed in the molten metal in a molten metal holding furnace, and another end connected to the mold. The outlet opening of the mold stays at the same level of height with the surface of the molten metal in the holding furnace.

The dummy bar 3 is applied to the lower end $\alpha$ of the mold 1 as shown in FIG. 1(*a*) before the molten metal is introduced into the mold 1. As the upper end of the dummy bar 3 contacting the molten metal 2 has a temperature lower than the solidifying temperature of the molten metal, and the molten metal in the mold 1 begins to solidify in the center of the mold 1 adjacent the bar end, while not solidifying in an area adjacent to the hot inner wall of the mold 1. If the dummy bar 3 is moved down away from the lower end of the mold 1 while being cooled by the cooling device 5, the solidified metal body or ingot 4 gradually grows, and is discharged continuously from the mold 1, as shown in FIG. 1(*b*). As the inner wall of the mold has a temperature which is higher than the solidifying temperature of the metal, a solid skin defining the peripheral surface of the ingot is not formed in the mold, but immediately below the outlet opening of the mold to thereby provide the ingot with a very smooth surface.

According to an important aspect of this invention, the pressure of the molten metal at the bottom outlet opening of the mold is kept in the vicinity of zero, since the molten metal blows out if the solid skin is not formed within 1 mm below or so the outlet opening of the mold.

According to this invention, it is also important to control the molten metal temperature, and the cooling rate and discharge speed for the ingot appropriately. It is particularly important to ensure an adequate balance between the cooling rate and discharge speed for the ingot. If the ingot is cooled too fast as compared with its discharge speed, the molten metal solidifies within the mold, and its solid skin adheres to the mold. The resulting ingot has an inferior surface which not only does damage to the inner wall of the mold, but also prevents the smooth removal of the ingot from the mold. Accordingly, the heater is provided in the mold to hold the inner wall of the mold at an appropriate high temperature.

In order to avoid the aforesaid problem, it is also effective to form the inner wall of the mold slightly divergent toward its outlet opening. This enables the removal of the ingot without doing damage to the inner wall of the mold even if the dummy bar is cooled too fast, resulting in the solidification of the molten metal out of the mold surface.

It has been experimentally found by the inventor that if the molten metal at the outlet opening of the mold has a pressure not exceeding 0.002 kg/cm$^2$, the continuous casting operation can be carried out without causing any breakout during the upward or downward casting of almost all kinds of metals and alloys. It has also been found that a molten metal pressure up to 0.005 kg/cm$^2$ is permissible for horizontal casting if the solidified core of metal is allowed to form to a greater extent within the mold.

The mold may be formed from graphite, a refractory material consisting mainly of an oxide such as silicon oxide, aluminum oxide, beryllium oxide, magnesium oxide or thorium oxide, a refractory material consisting mainly of a nitride such as boron or silicon nitride, silicon carbide, a refractory metal such as platinum, tungsten or tantalum, or an alloy of any such metal. It is possible to use a glass mold for casting a metal having a low melting point, such as tin.

A metal having a melting point lower than about 500° C., such as zinc, lead cadmium, or tin, or an alloy thereof, and a metal having a melting point lower than about 1,000° C., such as copper, aluminum, or magnesium, or an alloy thereof can be cast in the open atmosphere by a mold formed from graphite, silicon carbide, boron nitride, alumina, silica, magnesia, or almost all other oxides or nitrides.

The heater for the mold may be an ordinary resistance heating element formed from, for example, a ferro-chrome, nickel-chrome, tungsten-rhenium or platinum-rhodium alloy, molybdenum, platinum, tantalum or silicon carbide. For the casting of cast iron or steel, or any other metal or alloy having a high melting point, however, it is necessary to protect the mold and the heater therein against deterioration by oxidation, or breakdown in a hot atmosphere. For this purpose, it is necessary to protect the mold by an inert gas atmosphere, such as nitrogen, argon or helium.

The dummy bar and the continuously cast ingot leaving the mold can be sufficiently cooled by the open air if the ingot is of a metal having a low melting point or an alloy thereof. It is, however, desirable to employ forced cooling by water or a gaseous coolant if the ingot is of a metal having a medium melting point, such as aluminum, magnesium or copper, or an alloy thereof, or a metal having a high melting point, such as iron or steel, or an alloy thereof.

For water cooling of an ingot cast in an upward direction, it is possible to use a cooling device having an upwardly inclined nozzle directed toward the peripheral surface of the ingot to blow an upwardly directed jet of pressurized water against the ingot surface to thereby prevent water from falling on the molten metal surface.

Figure 2:
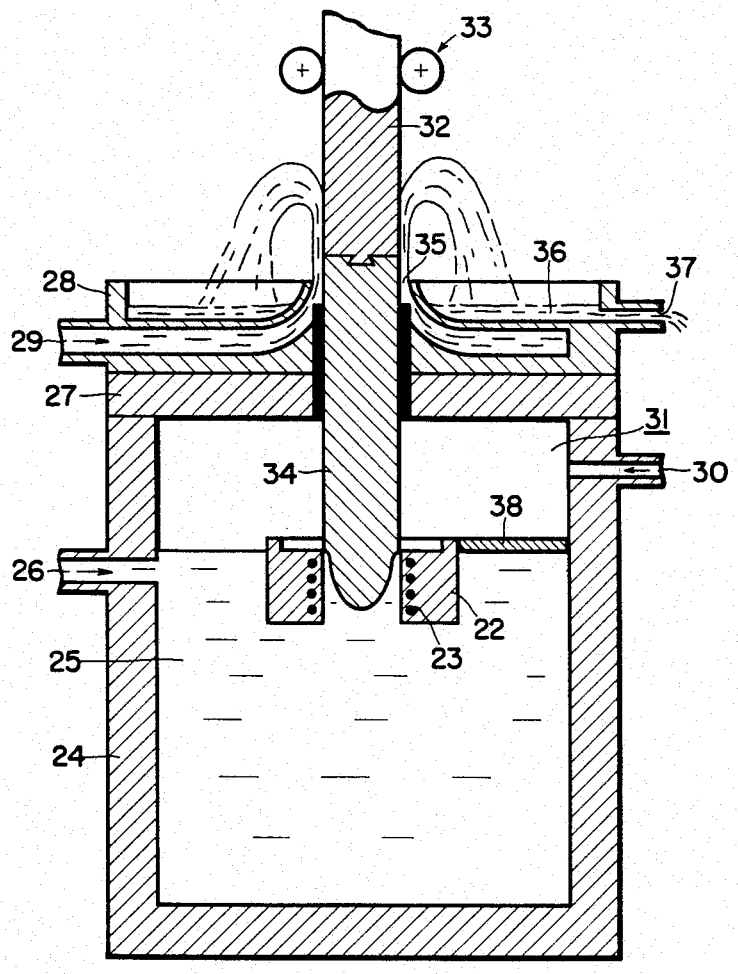
FIG. 2 is a vertical sectional view of an apparatus which may be employed to carry out the process of this invention as applied to continuous casting in an upward direction.

FIG. 2 shows by way of example a water-cooled continuous upward casting apparatus including a hot mold protected by an inert gas atmosphere. A mold 22 is formed at its top with an outer peripheral edge which prevents any overflow of the molten metal. An electric resistance heater 23 is embedded in the inner wall of the mold 22. The mold 22 is substantially immersed in the molten metal 25 in a molten metal holding furnace 24. The molten metal 25 has a surface maintained at a constant level of height by a controlled supply of molten metal through a molten metal supply pipe 26. A water-cooling device 28 is lined with insulating refractories 27, and disposed on the top of the holding furnace 24. The device 28 is divided into two vertically spaced apart portions as shown in FIG. 2, and cooling water is supplied through the lower portion, and discharged through the upper portion. The lower portion has a water inlet 29 through which pressurized water is introduced, and an outlet 35 through which an upwardly inclined jet of water is directed against the peripheral surface of a dummy bar 32 or a continuously cast ingot 34. The water moves up the surface of the dummy bar 32 or the ingot 34, and falls into a receptacle 36 in the upper portion of the cooling device 28 to be eventually discharged through an outlet 37.

The holding frame 24 has an inlet 30 for an inert gas, such as nitrogen, argon or helium. The inert gas is introduced into the furnace 24 through the inlet 30 to maintain a gas pressure higher than the atmospheric pressure in the furnace to provide an inert gas atmosphere around the mold 22. A pair of pinch rolls 33 control the vertical movement of the dummy bar 32 and the upward removal of the ingot 34. The furnace 24 is provided with a supporting member 38 which holds the mold 22 in position.

According to the apparatus shown in FIG. 2, the mold is immersed in the molten metal to maintain an inner wall temperature higher than the solidifying temperature of the metal. The immersion of the mold is, however, not always required for continuous casting in an upward direction. It is, for example, possible to employ a furnace having a molten metal holding zone and a casting zone, and connect an externally heated mold to the casting zone so that the molten metal may be supplied under pressure from the holding zone to the mold. This type of apparatus is shown by way of example in FIG. 3.

Figure 3:
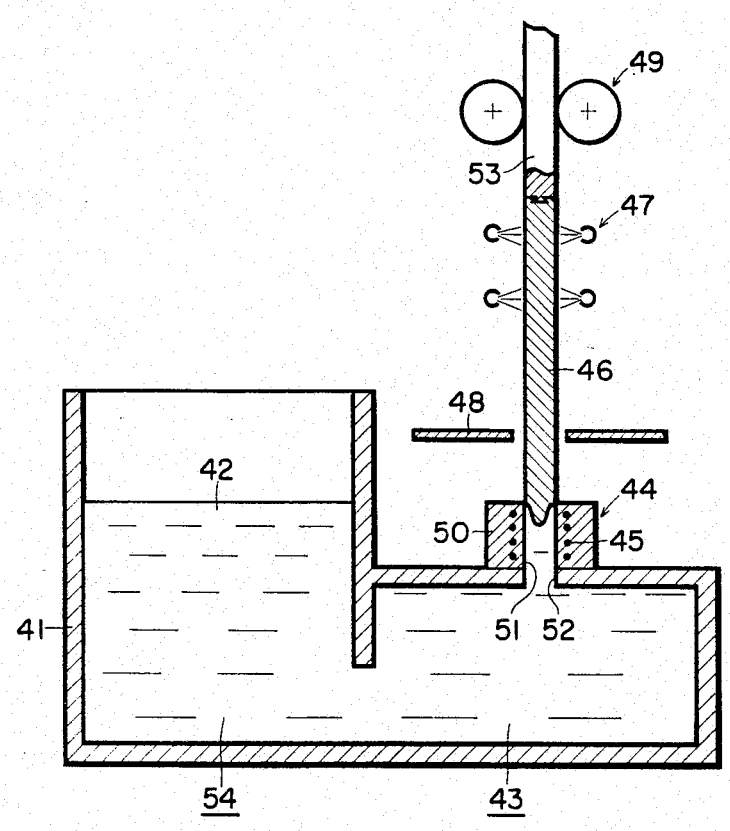
FIG. 3 is a vertical sectional view of another apparatus for carrying out the process of this invention as applied to continuous casting in an upward direction.

Referring to FIG. 3, a molten metal holding furnace 41 has a molten metal holding zone 42, and a casting zone 43 of the closed type. A mold 50 having an external heater 45 is situated on the top center of the casting zone 43. The mold 50 is open at both of its vertically spaced apart ends, and its lower end opening 51 is connected with a molten metal outlet 52 provided on the top of the casting zone 43. A dummy bar 53 is vertically movable upon rotation of a pair of pinch rolls 49 connected to an appropriate driving unit not shown. The dummy bar 53 is brought into contact with the molten metal in the mold to gradually lift a continuously cast ingot 46.

The apparatus shown in FIG. 3 is characterized by the molten metal holding zone 42 in which an appropriately controlled level of height may be maintained for the surface of the molten metal therein to enable the molten metal to be supplied into the mold with a certain amount of pressure. This facilitates the production of a cast product having a relatively small cross-sectional area in the form of, for example, a sheet or a wire rod having a very small diameter. The apparatus also has the advantage that the mold 50 is easy to remove for repair purposes, since it is located outside the furnace.

The mold 50 can be inclined to some extent to cause an ingot to be lifted by the dummy bar along an upwardly inclined path. This arrangement enables the water cooling of the dummy bar and the ingot without any fear of cooling water flowing down into the molten metal in the mold.

Figure 4:
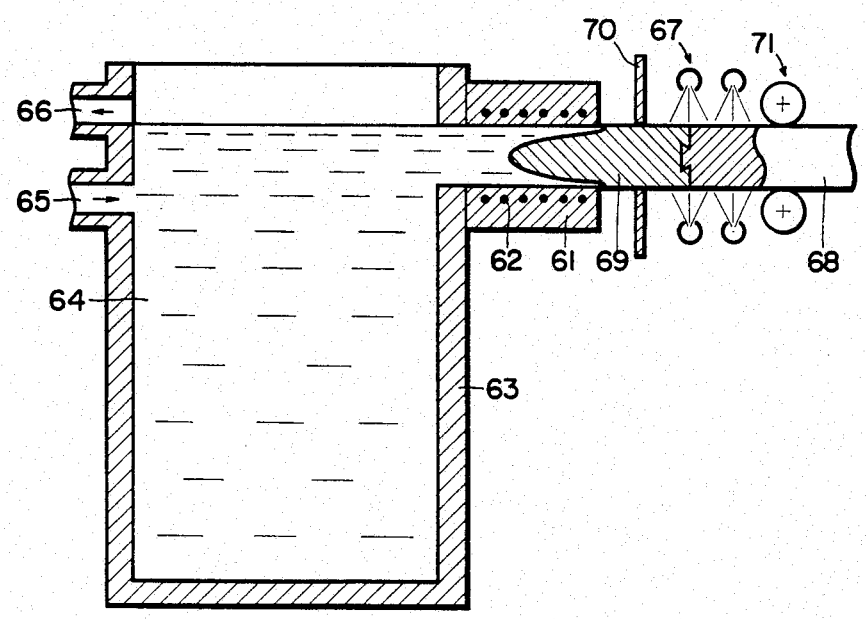
FIG. 4 is a vertical sectional view of an apparatus for carrying out the process of this invention as applied to continuous casting in a horizontal direction.

Referring now to FIG. 4, there is shown by way of example an apparatus for continuous casting in a horizontal direction. The apparatus includes a mold 61 provided therein with an electric resistance heater 62. The cavity of the mold 61 has an upper extremity which is flush with the surface of the molten metal 64 in a molten metal holding furnace 63. The furnace 63 has a molten metal supply pipe 65, and an overflow outlet 66 for any extra metal, whereby the surface of the molten metal in the furnace is always maintained at a constant level of height which ensures that the molten metal have a pressure of 0.005 kg/cm$^2$ or less at the lower extremity of the outlet of the mold. A cooling device 67 sprays jets of water to cool a dummy bar 68 or a continuously cast ingot 69. A partition 70 is provided between the mold 61 and the cooling device 67 for preventing any scattering of water that may cool the mold 61. A pair of pinch rolls 71 control the horizontal movement of the dummy bar 68 and the removal of the ingot 69 from the mold 61. Although the mold 61 is shown as being mounted in a horizontal position, it can alternatively be situated in a downwardly inclined position to prevent any cooling water from being directed to the mold.

Attention is now directed to the application of this invention to continuous casting in a downward direction. It is effective to use a siphon pipe for feeding the molten metal into a mold in order to maintain the pressure of the molten metal at the outlet opening of the mold at substantially zero. This type of apparatus is shown by way of example in FIG. 5.

FIG. 5 shows a mold 81 provided with a heater therein, and a siphon pipe 82 having one end connected to the mold 81, while the other end of the siphon pipe 82 is immersed in the molten metal 84 in a molten metal holding furnace 83. The heater 85 comprises an electric resistance heater which maintains the bottom of the inner wall of the mold 81 at a temperature higher than the solidifying temperature of the molten metal. A dummy bar 86 is applied to the lower end of the mold 81, and lowered by a pair of rotating pinch rolls 88 while being cooled by a spray of water from a cooling device 87, whereby an ingot 89 having a smooth and beautiful surface is formed continuously on the top of the dummy bar 86.

The siphon pipe 82 is provided with an air bleed valve 90, while the furnace 83 has an overflow opening 91. The valve 90 is opened, and the overflow opening 92 closed to start the supply of the molten metal to the mold 81 through the siphon pipe 82. An elevated level of the molten metal in the furnace 83 causes the molten metal to fill the siphon pipe 82 and reach the mold 81. Then, the valve 90 is closed, and the overflow opening 91 opened so that the level of the molten metal 84 may be lowered and stay at the same height with the lower end of the mold 81. As the dummy bar 86 is gradually lowered, the ingot 89 can be continuously cast without encountering any danger of breakout. The siphon pipe 82 is covered by an insulation 93 which can be provided with a heater therein if required.

According to the process of this invention, the molten metal has a substantially zero pressure at the outlet of the mold, except for the production of small cast products, such as a wire rod having a small diameter or a sheet having a very small thickness, which is preferably carried out with a certain molten metal pressure at the mold outlet. Accordingly, there is no fear of the breakout of any molten metal. Since the inner wall of the mold is maintained at a temperature higher than the solidifying temperature of the molten metal, the metal does not form a solid skin within the mold, but there is obtained an ingot having a smooth and beautiful surface irrespective of the metal or alloy involved. Since the solid skin does, therefore, not adhere to the inner wall of the mold, this invention is advantageously applicable to the production of not only ingots having relatively simple shapes as obtained by any conventional continuous casting process, but also ingots having a variety of other relatively complicated cross-sectional configurations directly corresponding to the final products for sale.

According to the process of this invention, it is possible to obtain an ingot having a unidirectionally columnar fiber structure. The process is, therefore, of greater advantage for the production of an ingot for a magnet, a silicon steel sheet, a eutectic composite or like product which requires a unidirectionally solidified structure. It is also possible to produce a sheet, tube, shaped product, or the like of stainless steel, or any other metal or alloy that is difficult to work by plastic deformation from an ordinary ingot. If the dummy bar is rotated about its own axis when moved from the mold, it is possible to cast a wire or bar having a longitudinally twisted configuration, such as a reinforcing iron bar for burying in concrete.

According to this invention, it is also possible to cast continuously from a molten metal a high-melting superalloy casting having a unidirectionally solidified structure, such as a gas turbine blade, and thereby provide a greatly improved substitute for the conventional process which employs a chilling block and a hot top for a refractory mold to cast each such product individually. The following Examples serve to illustrate the preferred process for continuous casting of metal ingots according to the present invention.

EXAMPLE 1

A cylindrical graphite mold having an inside diameter of 12 mm, an outside diameter of 20 mm and a height of 30 mm, and which was open at its upper and lower ends was mounted to an upwardly continuous casting apparatus of the type shown in FIG. 2 so that its upper end was flush with the surface of molten metal in a molten metal holding furnace. The molten metal was 5% phosphor bronze consisting of 94.75% by weight copper, 5% by weight tin and 0.25% by weight phosphorus, had a temperature of 1,100° C., and was continuously supplied into the furnace to suit the amount of continuously cast metal leaving the mold so as to maintain the pressure of the molten metal at the outlet opening of the mold at substantially zero. The mold was covered by a nitrogen atmosphere, and heated by an embedded platinum wire heater so that its inner wall was maintained at a temperature of 1,100° C. A stainless steel dummy bar having a diameter which was substantially equal to the inside diameter of the mold was brought into contact with the surface of the molten metal in the mold. The dummy bar was, then, raised at a rate of 15 mm per minute while water was supplied at a rate of 100 cc per minute at a level of height 100 mm above the molten metal surface, whereby a phosphor bronze bar having a very smooth and beautiful surface was continuously cast on the lower end of the dummy bar.

EXAMPLE 2

A cylindrical zirconia mold having an inside diameter of 5 mm, an outside diameter of 12 mm and height of 30 mm, and which was open at its upper and lower ends was mounted in an upward continuous casting apparatus of the type shown in FIG. 3 so that its upper end might be slightly lower level than the surface of a molten metal in a molten metal holding furnace so as to maintain the pressure of the molten metal at the outlet opening of the mold at 0.002 kg/cm$^2$. The molten iron metal including 3.8% by weight carbon and 1.8% by weight silicon had a temperature of 1200° C., and was continuously supplied into the furnace to suit the amount of continuous cast metal leaving the mold.

The mold was heated by an embedded platinum wire heater so that its inner wall was held at 1,200° C. A steel dummy bar having a diameter which was substantially equal to the inside diameter of the mold was brought into contact with surface of the molten metal in the mold. The dummy bar was, then, raised at a rate of 10 mm per minute while water was being supplied at a rate of 50 cc per minute at a level of height 120 mm above the molten metal surface, whereby cast iron wire of 5 mm diameter having very smooth and beautiful surface was continuously cast on the lower end of the dummy bar.

EXAMPLE 3

A boron nitride mold having a rectangular cavity with a height of 3 mm and a width of 20 mm, and a wall thickness of 3 mm was mounted in a horizontally continuous casting apparatus of the type shown in FIG. 4. The mold temperature was held at 680° C. by an embedded heater. Molten aluminum (99.9% Al) having a temperature of 700° C. was continuously supplied from a holding furnace into the mold to suit the amount of continuously cast metal leaving the mold so as to maintain the pressure of the molten aluminum at the outlet opening of the mold at substantially zero. A cast product was discharged horizontally from the mold at a rate of 60 mm per minute, and cooled by water at a rate of 600 cc per minute at a distance of 50 mm from the outlet of the mold to yield an aluminum strip measuring 3 mm in thickness and 20 mm in width, and having a smooth and beautiful surface.

EXAMPLE 4

A columnar stainless steel core having a diameter of 12 mm was placed in a hollow cylindrical stainless steel mold having a wall thickness of 1.5 mm and an inside diameter of 16 mm in a downwardly continuous casting apparatus of the type shown in FIG. 5. The mold temperature was held at 240° C. by an embedded nickel-chrome heater. Molten tin (99.9% Sn) having a temperature of 270° C. was continuously supplied into the mold to suit the amount of continuously cast metal leaving the mold so as to maintain the pressure of the molten tin at the outlet opening of the mold at substantially zero, and a cast product was discharged downwardly therefrom at a rate of 40 mm per minute, and cooled by air blown at a rate of 50 liters per minute against the cast product at a distance of 20 mm from the outlet of the mold to yield a tin tube having a beautiful surface.

What is claimed is:

1. A continuous metal casting process comprising:

supplying a molten metal into a mold provided with an inlet and an outlet opening in such a manner that the pressure of said molten metal is maintained in the range of 0 to 0.005 kg/cm$^2$ at said outlet opening, while said mold has an inner wall maintained at a temperature sufficiently higher than the solidifying temperature of said metal so that the contiguous surface of the metal remains liquid while within the mold;

bringing a dummy bar having a temperature maintained lower than said solidifying temperature into contact with said molten metal at said outlet opening; and moving said dummy bar away from said outlet opening, whereby a solidified body of said metal is formed continuously on the end of said dummy bar as the metal body leaves the wall opening.

2. A process as set forth in claim 1, wherein said dummy bar is moved upwardly, and wherein said pressure is in the range of 0 to 0.002 kg/cm$^2$.

3. A process as set forth in claim 1, wherein said dummy bar is moved downwardly, and wherein said pressure is in the range of 0 to 0.002 kg/cm$^2$.

4. A process as set forth in claim 1, wherein said dummy bar is moved horizontally.

5. A process as set forth in claim 1, wherein at least said inner wall of said outlet opening is heated by a heater embedded therein, so that said temperature higher than said solidifying temperature may be maintained therein.

6. A process as set forth in claim 1, wherein said molten metal is supplied into said mold by a siphon having one end immersed in the molten metal in a molten metal holding furnace.

7. A process as set forth in claim 1, wherein a liquid or gaseous coolant or a mixture thereof is applied to said dummy bar or said solidified body to maintain said temperature lower than said solidifying temperature.

8. A process as set forth in claim 1, wherein a liquid coolant or a mixed gas-liquid coolant is applied to said dummy bar or said solidified body in such a manner that said coolant may remain in contact with the surface of said dummy bar or solidified body, and move in the direction in which said dummy bar or solidified body is moved away from said mold.

9. A process as set forth in claim 1, wherein said outlet opening of said mold is covered by an inert gas atmosphere.

10. A process as set forth in claim 1, wherein said inner wall of said mold is formed slightly divergent toward said outlet opening.

11. A process as set forth in claim 1, wherein said solidified body has a cross-sectional configuration corresponding to said outlet opening.

12. A process as set forth in claim 1, wherein said solidified body forms a solid skin immediately after leaving said outlet opening.

* * * * *